United States Patent [19]

Geibel

[11] Patent Number: 4,736,804

[45] Date of Patent: Apr. 12, 1988

[54] OVERHEAD DRILL JIG

[76] Inventor: Jeffrey B. Geibel, 5345 Waterbury Way, Crestwood, Ill. 60445

[21] Appl. No.: 939,531

[22] Filed: Dec. 9, 1986

[51] Int. Cl.[4] ..... E21C 11/00

[52] U.S. Cl. ..... 173/30; 173/36; 408/99; 408/136

[58] Field of Search ..... 173/30, 31, 34, 36, 173/141, 21, 37; 408/99, 100, 136, 712; 248/644, 125

[56] References Cited

U.S. PATENT DOCUMENTS

| | | | |
|---|---|---|---|
| 1,293,238 | 2/1919 | St. Pierre | 77/30 |
| 2,405,110 | 8/1946 | Bullock | 77/7 |
| 2,440,852 | 5/1948 | Elford | 77/7 |
| 2,571,862 | 10/1951 | Glenn | 255/51 |
| 2,720,125 | 10/1955 | Palik | 77/7 |
| 2,879,677 | 3/1959 | Baublitz | 408/136 |
| 2,908,482 | 10/1959 | Curtis et al. | 255/45 |
| 2,917,953 | 12/1959 | Badali | 173/36 |
| 2,947,204 | 8/1960 | Pine et al. | 77/7 |
| 3,400,770 | 9/1968 | Matson | 173/32 |
| 3,838,935 | 10/1974 | Boyajian | 408/712 |
| 3,890,058 | 6/1975 | Self et al. | 408/712 |
| 4,442,905 | 4/1984 | Agoston | 173/36 |

*Primary Examiner*—E. R. Kazenske
*Assistant Examiner*—James L. Wolfe
*Attorney, Agent, or Firm*—Edward W. Osann, Jr.

[57] ABSTRACT

An adjustable drill jig for drilling holes in an overhead work surface such as a ceiling by an operator standing on the floor. The device is portable and easily moved from one work area to another by one person. It may readily be adjusted from the floor to accommodate ceilings of different heights; to vary the depth of penetration by the drill; and to control the application of power to the drill.

10 Claims, 2 Drawing Sheets

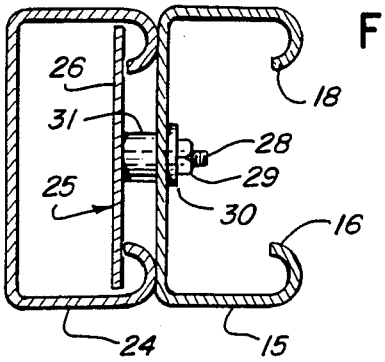
FIG. 4
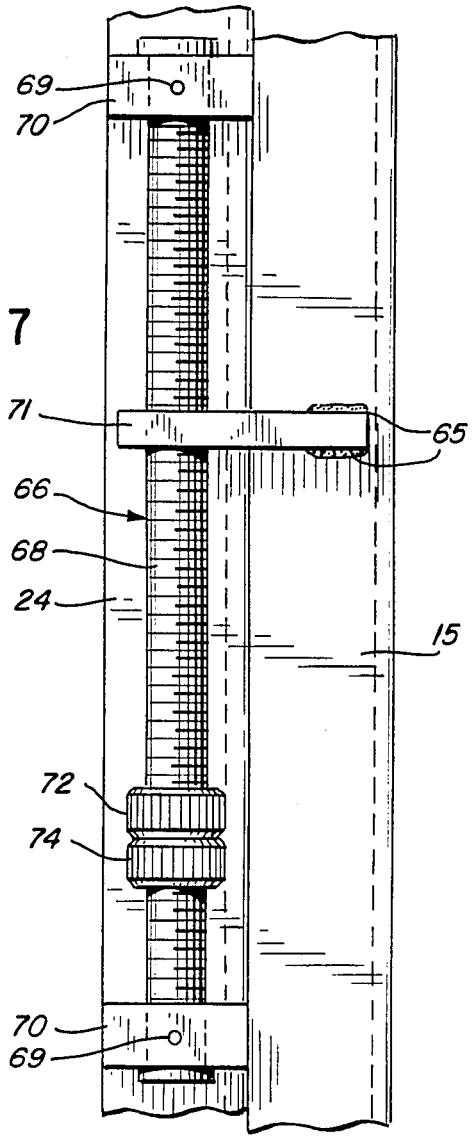
FIG. 7
FIG. 5
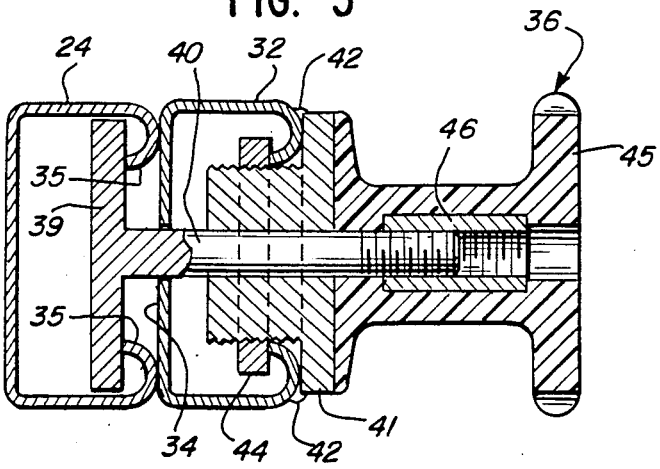
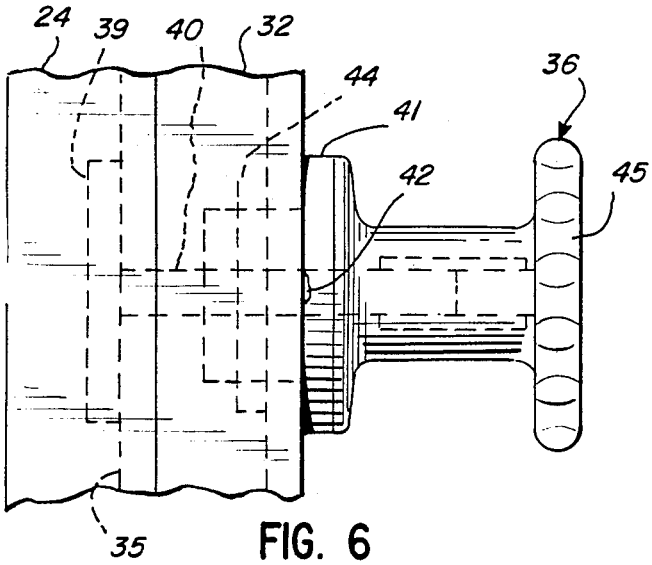
FIG. 6
FIG. 8
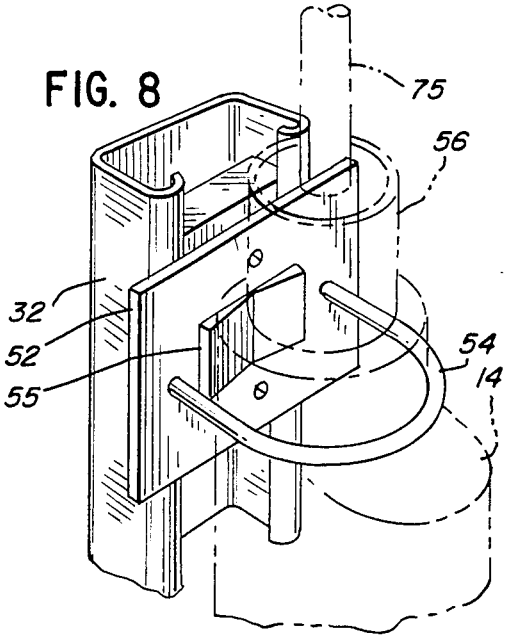

OVERHEAD DRILL JIG

BACKGROUND OF THE INVENTION

The present invention relates in general to an overhead drill jig of the portable type for supporting and feeding a power drill from the floor and against a ceiling or other overhead work surface.

In the construction of buildings and other structures, it is frequently necessary to drill holes into an overhead surface such as a ceiling which is out of reach of an operator standing on the floor. Customary practice in the past has been to erect ladders or scaffolding a few feet above the floor to make the overhead work area accessible to the drill operator. This procedure is cumbersome and time consuming, particularly if there are a substantial number of overhead areas where drilling is required. It also carries the risk of personal injury to the operator in the event of a fall.

The following prior art patents disclose various jigs for supporting a drill, including a number of overhead drill supporting and feeding arrangements:

| U.S. Pat. No. | Patentee | U.S. Pat. No. | Patentee |
|---|---|---|---|
| 1,293,238 | St. Pierre | 2,879,677 | Baublitz |
| 2,405,110 | Bullock | 2,908,482 | Curtis et al. |
| 2,440,852 | Elford | 2,947,204 | Pine et al. |
| 2,571,862 | Glenn | 4,442,905 | Agoston |
| 2,720,125 | Palik | | |

SUMMARY OF THE INVENTION

It is an object of the present invention to provide an overhead drill jig supported on the floor and extensible by the operator while standing on the floor to bring the drill into working position against a ceiling. As used herein, the term "ceiling" includes an overhead work surface and the term "floor" includes a rigid support area upon which a person can walk.

Another object of the invention is to provide an overhead drill jig of the character set forth above enabling the operator to adjust and control the depth of drilling while standing on the floor.

A further object of the invention is to provide an overhead drill jig of the above type adapted to operate while compensating for an uneven floor.

Still another object is to provide an overhead drill jig of the foregoing character which is of light weight but strong construction and readily portable from one position to another.

Another object is to provide an overhead drill jig as set forth above which is capable of operating satisfactorily with a wide variety of electric or air powered drills.

The foregoing is accomplished by constructing an adjustable overhead drill jig with a base supportable on the floor, an upstanding column attached to the base; a first strut slidably attached to the column in overlapping relation therewith, a second strut slidably attached to the first strut in overlapping relation therewith; means for locking the first and second struts together in a selected position against relative sliding movement; means for adjustably securing a power drill to the upper portion of the second strut; toggle link means activated by an operator standing on the floor for bodily elevating the struts and the drill in unison to cause the drill to penetrate the ceiling; and means for adjustably setting the depth of drill penetration into the ceiling by the operator when standing on the floor.

BRIEF DESCRIPTION OF THE DRAWINGS

FIG. 4 is an enlarged horizontal sectional view taken through the frictional device of the invention in the plane of the line 4—4 in FIG. 1.

FIG. 5 is an enlarged horizontal sectional view taken through the clamping device of the invention in the plane of the line 5—5 in FIG. 1.

FIG. 6 is a side elevational view of the clamping device shown in FIG. 5.

FIG. 7 is an enlarged elevational view illustrating the drill depth regulating device mounted between the support column and first strut as indicated in FIGS. 1–3 above.

FIG. 8 is an enlarged perspective view detailing the upper drill clamping device adjacent the upper end of the second strut as indicated in FIGS. 1—3 above.

While the present invention is susceptible of various modifications and alternative constructions, there is no intention to limit the invention to the specific form illustrated and described herein. On the contrary, the intention is to cover all modifications and alternative constructions falling within the spirit and scope of the invention as set forth in the appended claims.

DETAILED DESCRIPTION OF THE INVENTION

Figure 1:
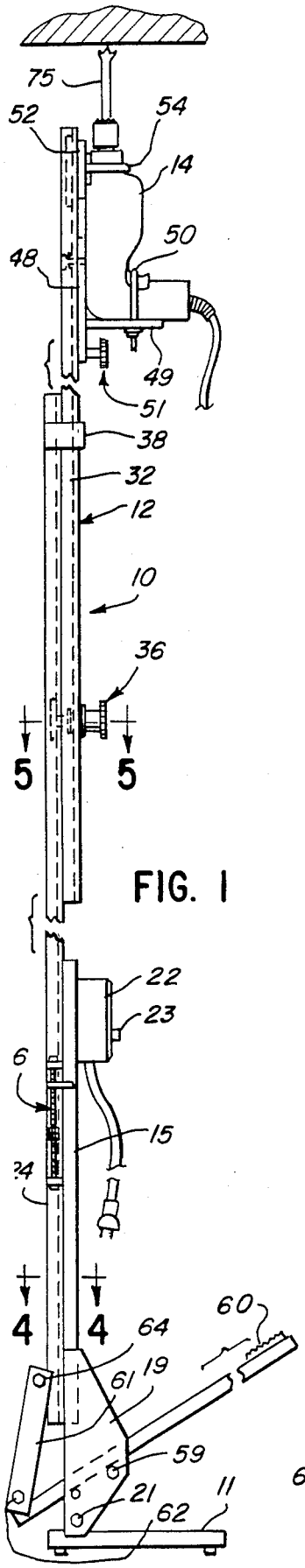
FIG. 1 is a perspective view of an overhead drill jig exemplifying the present invention, illustrating the controls and the drill in operation.
Figure 2:
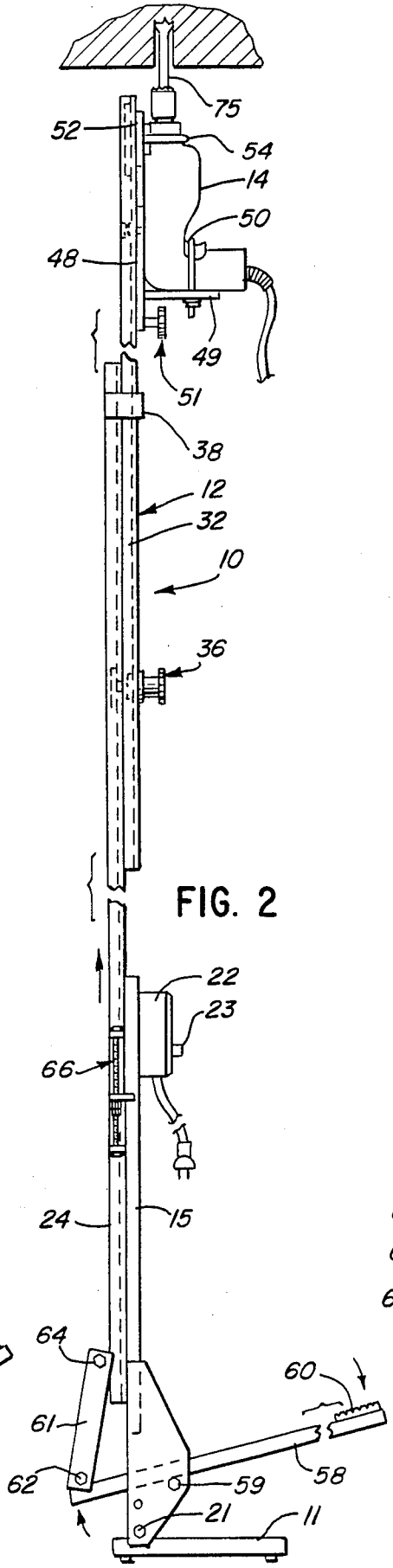
FIGS. 2 and 3 are side elevational views of the overhead drill jig shown in FIG. 1, with the device in initial position as shown in FIG. 2 and into a drilling cycle as shown in FIG. 3.
Figure 3:
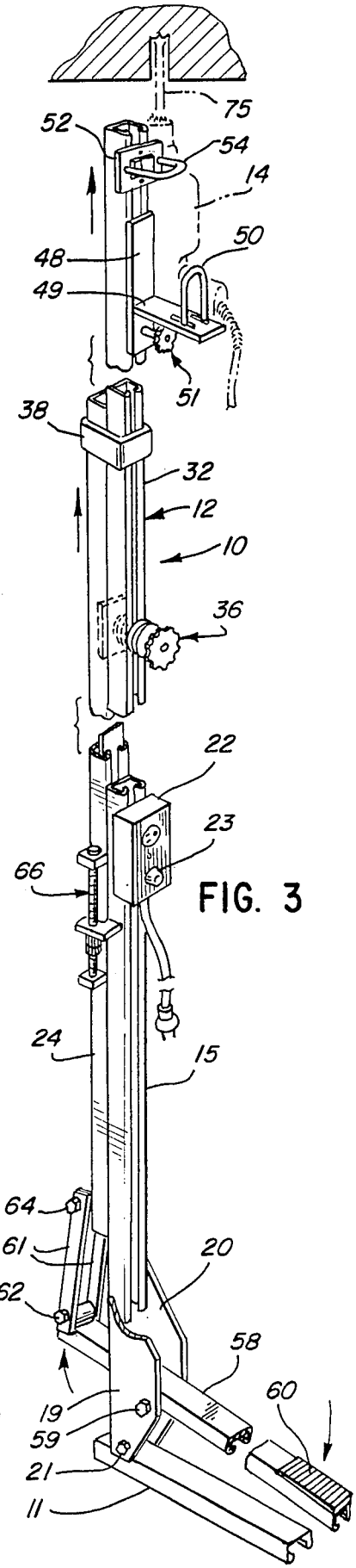

Referring more specifically to FIGS. 1–7, the invention is there exemplified in a novel, floor supported overhead drill jig 10 adapted for performing drilling operations in overhead work surfaces such as ceilings or various structural members. The drill jig 10 is fabricated of light weight component members that make it readily portable yet sufficiently strong to perform a great variety of drilling operations.

In accordance with the invention, the overhead drill jig 10 comprises a floor supported base 11 and an extensible column assembly 12 holding a power drill 14 adjacent its upper end. The drill jig 10 is designed so as to be controlled and adjusted by an operator standing on the floor alongside the device.

Referring more specifically to the drill jig 10, the latter comprises the base 11 and an upstanding column 15 which may be of channel cross-section with the edge portions 16, 18 of its flanges in-turned. The column 15, which may be approximately waist-high to accommodate the operator, is pivotally connected to the base 11 by means of a pair of laterally spaced gusset plates 19, 20 and a cross bolt 21. In this instance, an electric outlet box 22 with a dust-proof push button switch 23 is mounted adjacent the upper end of the column 15 for controlling the application of power to the drill.

A first or lower movable strut 24 of channel cross-section is slidably mounted on the column 15 in overlapping parallel relation therewith for movement along a common longitudinal plane. It is maintained in sliding engagement with the column 15 by means of one or more yieldable friction clamping devices 25 (FIG. 4) interposed between the column 15 and the lower strut 24. Each such device in the present instance may comprise a friction plate 26 slightly narrower in width than the inside distance between the channel flanges of the column 15. The friction plate 26 overlaps and frictionally engages the in-turned end portions 16, 18 of the channel flanges. The plate 26 has a threaded stem 28 which extends through an aperture in the back of the column 15 and is retained by a nut 29 and lock washer 30. The stem may carry a bushing 31 of stiffly yieldable material between the plate 26 and the outer face of the column 15 to permit adjustment of the frictional force exerted by the device 25.

A second or upper movable strut 32 also of channel cross-section is slidably mounted on the first strut 24 in overlapping parallel relation with same. The back face 34 of the strut 32 abuts the in-turned edge portions 35 of the channel flanges on the strut 24 (FIG. 5). The struts 24, 32 may be adjusted longitudinally to increase or decrease their combined length and thereby facilitate positioning of the drill 14. Such adjustment may be effected by means of a manually actuated clamping device 36 and a cooperating guide bracket 38.

The manually actuated clamping device 36 (FIGS. 5, 6) comprises a relatively heavy friction plate 39 housed inside the first strut 24 and disposed to bear against the in-turned edge portions 35 of the channel flanges of strut 24. The plate 39 has a relatively heavy threaded stem 40 fixed thereto and extending through an aperture in the back of the strut 32, terminating substantially beyond the front of that strut. A metallic annular support collar 41 is secured against turning as by welds 42 on the outer end portions of the channel flanges of strut 32 and by retainer nut 44 inside the strut 32. An adjusting hand wheel 45, in this case having a generally spool shaped configuration, threadly engages the projecting end portion of the stem 40. In this case, the hand wheel 45 happens to be fabricated of plastic or other non-metallic material with an inner threaded sleeve 46 of metal such as brass. The hand wheel 45 could also be fabricated entirely of metal.

Provision is made in the drill jig 10 for adjustably supporting the drill 14 on the upper end portion of the second or upper strut 32. This is accomplished by means of a drill support comprising a vertically adjustable slide 48 having an integral platform 49 for receiving the handle portion of the drill 14. The platform is provided with means such as U-bolt 50 for clamping the drill to the platform. The latter may be adjusted longitudinally of the strut 32 and secured in position by means of a hand wheel actuated clamp 51 like the clamp 36 but somewhat smaller. A second drill engaging means in the form of an independent slide 52 is situated in spaced relation above the drill support slide 48 and includes means (not shown) for adjustably clamping it to the upper end portion of the strut 32. The slide 52 has a clamping means in the form of a U-bolt 54 and angular centering pad 55 for snugly holding the nose of the drill in position. The slide 52 and drill support 48 are so positioned that the outer end of the drill chuck 56 is situated slightly above the upper end of the strut 32.

In order to bring the drill 14 into operating position, the drill jig 10 is provided with a foot operated lever 58 pivotally mounted on a cross bolt 59 through the gusset plates 19, 20 of the base. The end of the lever 58 remote from the foot tread 60 is pivotally connected to the lower end portion of the strut 32 by links 61 and pivot pins 62, 64. That portion of the foot lever 58 between the cross bolt 59 and the pivot pin 62, and the toggle links connected between the pins 62, 64, constitutes a toggle linkage which provides substantial mechanical advantage. When the operator, standing on the floor, steps on the tread 60 of the lever 58, the struts 24, 32 and drill 14 are raised and the drill goes through its operating cycle against the ceiling. At the conclusion of the operating cycle, the operator takes his foot off the lever 58 and the drill and strut assembly move down to their lower position under gravity.

For the purpose of regulating the depth of the hole or holes to be drilled using the overhead drill jig of the present invention, an adjustable stop mechanism 66 is provided (FIGS. 1–3, 7). The latter comprises a stop screw 68 secured as by means of pins 69 to a spaced apart pair of brackets 70 mounted on one side of the movable strut 24. A generally L-shaped fixed stop member 71 is secured as by welds 65 to the adjacent side of the upstanding column 15. The member 71 is formed with an aperture which fits closely with the stop screw 68 while maintaining an adequate working clearance. Cooperating with the stop member 71 are a pair of knurled stop nuts 72, 74 threaded on the screw 68. The upper nut 72 is the stop which engages the fixed stop member 71 to define the working travel of the drill bit 75 into the ceiling. The lower nut 74 serves to lock the stop nut in a preselected position on the stop screw 68.

It will be appreciated from the foregoing that the stop screw 68 could be mounted on the column 15 and the fixed stop member 71 mounted on the movable strut 24. The only change necessary in that instance would be to have the stop member 71 spaced below, rather than above, the stop nuts.

The drill jig 10 may readily be adjusted to accommodate ceilings or other overhead work surfaces of different heights. This is accomplished by loosening the large hand wheel 45 on the front of the second movable strut 32, raising or lowering the strut 32 and the drill 14 in unison by grasping the hand wheel 45, and then tightening the hand wheel 45 when the drill has been set at the new height. All of this adjustment may be easily accomplished by the operator while standing on the floor in front of the drill jig 10.

I claim as my invention:

1. An adjustable jig for drilling holes in an overhead work surface such as a ceiling and comprising, in combination:

(a) a base positionable on a fixed support surface such as a floor;

(b) an upstanding column pivotally attached to said base;

(c) a drill control mounted on said column;

(d) a first strut slidably attached to said column in overlapping relation therewith for movement along a common longitudinal plane therebetween;

(e) a second strut slidably attached to said first strut in overlapping relation therewith;

(f) means for adjustably locking said first and second struts together against relative sliding movement when in a selected position of longitudinal overlap;

(g) means for adjustably securing a power drill to the upper end portion of said second strut with the drill bit projecting beyond said upper end portion of the latter;

(h) toggle link means actuated by an operator on said fixed support surface for bodily elevating said struts and said drill in unison along said common longitudinal plane relative to said column to cause said drill to penetrate said overhead work surface; and (i) means for adjustably setting the depth of drill penetration into said overhead work surface.

2. The drill jig defined in claim 1, wherein said depth setting means comprises a stop screw fixed to one said member relatively slidable to an adjacent member; a fixed stop on said adjacent member; and stop element means threadedly engaged on said stop screw and engageable with said fixed stop to define a selected drill stroke.

3. An adjustable jig for drilling holes in an overhead work surface such as a ceiling and comprising, in combination:

(a) a base positionable on a fixed support surface such as a floor;

(b) a column attached to said base;

(c) a first strut slidably attached to said column in overlapping relation therewith for movement along a common longitudinal plane therebetween;

(d) a second strut slidably attached to said first strut in overlapping relation therewith;

(e) means for locking said first and second struts together against relative sliding movement when in a desired position of overlap;

(f) means for adjustably securing a power drill to the upper end portion of said second strut;

(g) toggle link means actuated by an operator on said fixed support surface for bodily elevating said struts and said drill in unison along said common longitudinal plane relative to said column to cause said drill to penetrate said overhead work surface; and (h) said toggle link means including a foot operated lever pivotally mounted on said base and a link pivotally connected to said lever and to said first strut.

4. An overhead drill jig as set forth in claim 2, wherein said first and second struts are slidably attached to each other in overlapping parallel relation therewith.

5. The overhead drill jig defined in claim 2, wherein said first and second struts are structural channels.

6. The overhead drill jig defined in claim 5, wherein said structural channels have in-turned edge portions.

7. An adjustable drill jig as set forth in claim 2, wherein yieldable frictional restraint means is interposed between said column and said first strut.

8. The adjustable drill jig defined in claim 2, wherein said strut locking means comprises a friction plate bearing against the in-turned edges of said first strut; a threaded stem connected to said friction plate extending through and beyond said second strut; and a hand wheel threadedly engaging said stem and adapted when tightened to restrain said struts against relative sliding motion.

9. The overhead drill jig defined in claim 2, wherein said second strut includes adjustable slide means for mounting an overhead drill.

10. The drill jig defined in claim 9, wherein said slide means includes two independently adjustable slide members.

* * * * *